US006478350B2

(12) United States Patent
Zuliani

(10) Patent No.: US 6,478,350 B2
(45) Date of Patent: Nov. 12, 2002

(54) PIVOTING LIFTING RING

(75) Inventor: Georges Zuliani, Luxembourg (LU)

(73) Assignee: SHBL S.A., Luxembourg (LU)

( * ) Notice: Subject to any disclaimer, the term of this patent is extended or adjusted under 35 U.S.C. 154(b) by 0 days.

(21) Appl. No.: 09/880,568

(22) Filed: Jun. 13, 2001

(65) Prior Publication Data

US 2002/0005645 A1 Jan. 17, 2002

(30) Foreign Application Priority Data

Jun. 15, 2000 (EP) ..... 00870131

(51) Int. Cl.[7] ..... B66C 1/66

(52) U.S. Cl. ..... 294/1.1; 294/89; 403/78; 403/164

(58) Field of Search ..... 294/1.1, 82.1, 294/89, 93; 411/353, 517; 403/78, 79, 164, 165

(56) References Cited

U.S. PATENT DOCUMENTS

| | | | | |
|---|---|---|---|---|
| 3,680,906 A | | 8/1972 | Neumeier | 294/89 |
| 4,735,450 A | * | 4/1988 | Fern | 294/81.53 |
| 4,802,700 A | * | 2/1989 | Stevenson et al. | 292/327 |
| 4,863,205 A | * | 9/1989 | Schron et al. | 294/82.28 |
| 5,690,457 A | | 11/1997 | Smetz | 411/400 |

FOREIGN PATENT DOCUMENTS

| | | |
|---|---|---|
| DE | 84 06 130 U | 5/1984 |
| DE | 4240090 | 6/1994 |
| DE | 43 36 780 A1 | 4/1995 |
| EP | 365430 | 4/1990 |
| FR | 2110367 | 6/1972 |
| GB | 229557 | 2/1925 |
| WO | WO 9010803 | 9/1990 |

* cited by examiner

*Primary Examiner*—Dean J. Kramer
(74) *Attorney, Agent, or Firm*—Olson & Hierl, Ltd.

(57) ABSTRACT

A lifting ring for a load, comprising a carrying loop, a pivoting body and a smooth cylindrical pin. A peripheral groove is formed near the free end of the cylindrical pin and a radially expandable retainer ring is inserted in the groove. The pin is engaged and locked axially in a cylindrical housing integral with the body of the load. The cylindrical housing comprises a peripheral channel opposite the groove of the pin, in which the expandable retainer ring is inserted.

Figure 1:
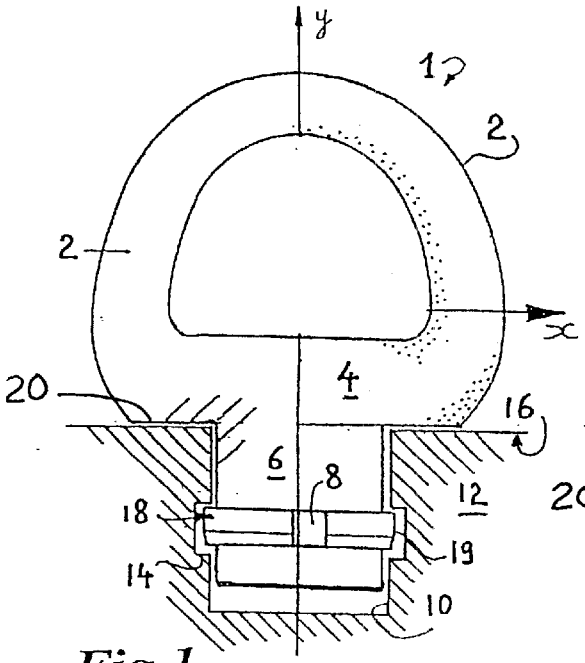

19 Claims, 3 Drawing Sheets x
y
2
4
6
10
12
18
19
22
24
26
34
36
36a
36b
38
40
44

PIVOTING LIFTING RING

FIELD OF THE INVENTION

The invention relates to lifting rings, especially for heavy loads.

The lifting ring of the invention is more specifically intended for hanging loads requiring precise manoeuvres of positioning and orientation, such as industrial injection moulds, etc.

DESCRIPTION OF PRIOR ART

Conventional pivoting lifting rings comprise a pivoting body supporting a shackle and an anchor element consisting of a threaded rod.

Such rings are disclosed in particular in WO 90/10803 and GB 2 303 682.

Practice reveals that these rings raise a series of problems. Their weak point (rupture zone) is not usually the ring but the junction between the threaded part and the bearing face where the ring is placed against the load. This observation is found to be true with one-piece rings as well as articulated rings (it becomes worse if the ring is not perfectly in contact with the bearing face).

Besides this, users of tooling (particularly in the case of plastic injection moulds) often find the rings difficult to deal with as they leave little room for the lifting hook to be inserted, to such an extent that the various connectors, unions and pipelines become torn during handling, more especially when the handled parts are being turned over.

There is therefore a real need to safely increase the distance between the point of application of the hook and the surface of the moulds, but also a separate problem of safety, because very often users will resort to ad-hoc arrangements and other hazardous solutions with rings mounted on extension pieces to provide more distance between the point of application of the hook and the bearing face of the load.

SUMMARY OF THE INVENTION

The invention solves the above problems by providing rings with smooth shanks, with a retention system as set out in the technical report given below, and also makes possible, owing to the extra room achieved, the addition of a base whereby rings can have a large clearance combined with exceptional strength.

The subject of the invention is a lifting ring for a load, comprising a carrying loop, a pivoting body and an element that anchors in the body of a load in which the anchor element is a smooth cylindrical pin. A peripheral groove is formed near the free end of this pin, and an expandable retainer ring is inserted in said groove. The pin is engaged and locked axially in a cylindrical housing integral with the body of the load by the retainer ring. The cylindrical housing comprises a second peripheral groove opposite the groove in the pin, in which the expandable retainer ring is inserted.

The expandable retainer ring is preferably a split spring ring, or comprises a spring part exerting an outward force on rollers or segments so as to engage them in the channel.

The loop may be an integral part of the body of the ring. Alternatively it passes through an eye incorporated in the body of the ring.

In an advantageous embodiment, the cylindrical housing in which the pivoting body is mounted is formed in base fixed to the body of the load.

The top of this base may have a large clearance forwards of the surface of the load, thus facilitating hanging operations.

If so, it is advantageous to have the cylindrical housing pass through the base.

The cylindrical housing then advantageously comprises a section of larger diameter towards the back of the base, with an annular holder being inserted along this section, between the base and the pin, to keep the retainer ring or its components in place.

The pin may project beyond the back of the base into a cavity of corresponding diameter formed in the body of the load, thus improving its centring and its retention.

The invention also relates to a body for a lifting ring as described above, which comprises a loop, and a smooth cylindrical pin, a peripheral groove being formed near the free end of this pin and an expandable retainer ring being inserted in said groove.

A clamping collar advantageously keeps the retainer ring compressed and in position before the smooth pin is inserted in an appropriate housing.

One advantage of the invention is that the strength of the shank can be increased because, for example, a smooth pin with a diameter of 48 mm is stronger than an M 48 thread, especially at the junction with the ring. It is easy to increase strength by increasing the diameter from Ø 48 to Ø 56, which will increase the strength by about 1.8, thus offering a capacity for use in traction at 90° close to that of axial traction. As a rule, the loss of efficiency at 90° is of the order of 40% compared with axial traction, owing to the weakness at the point of junction with conventional rings in both one-piece and articulated designs.

The cost of a smooth shank Ø 56 is less than that of a threaded shank Ø 48, despite the smaller diameter.

Another advantage is that the invention solves the problem of tightening (or forgetting to tighten): a ring cannot only half snap or lock into position. Moreover, the capacity at the connection of the rod with the ring is reinforced.

The lifting ring according to the invention gives the manufacturer guaranteed values, corresponding to the drive for standardization, particularly from the major customers in the plastics industry, but also in other industries.

SHORT DESCRIPTION OF THE DRAWINGS

Other features and advantages of the invention will become clear in the following description of certain particular embodiments, reference being made to the appended drawings, in which FIG. 1 is a side view of one embodiment of the ring housed in a load (in cross section)

Figure 2:
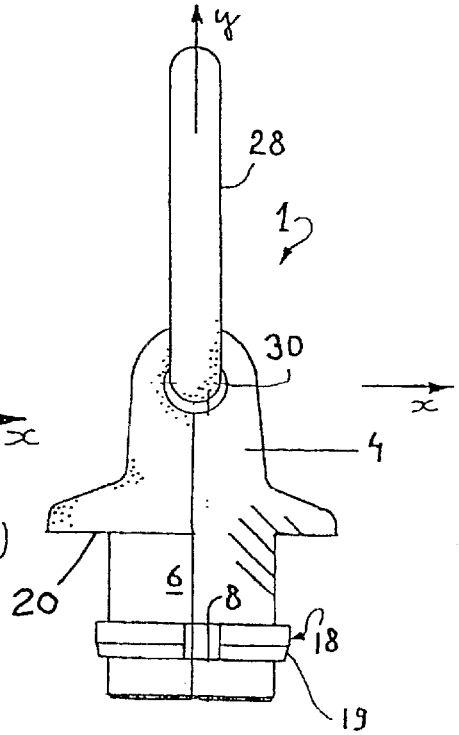
Figure 3:
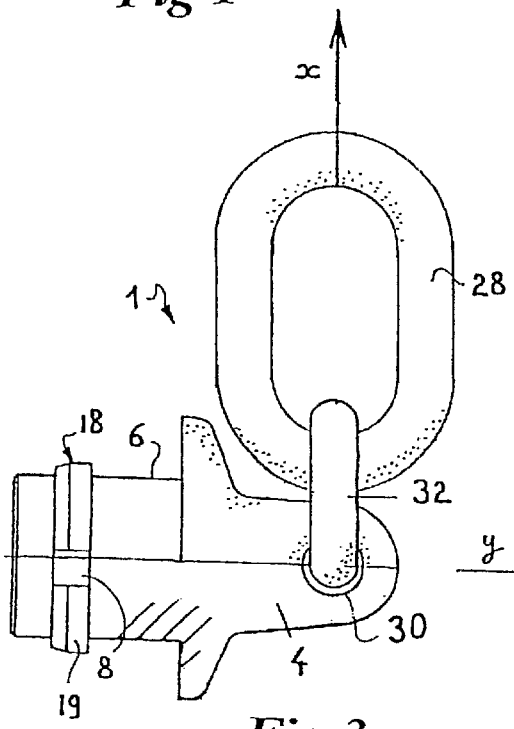
Figure 5:
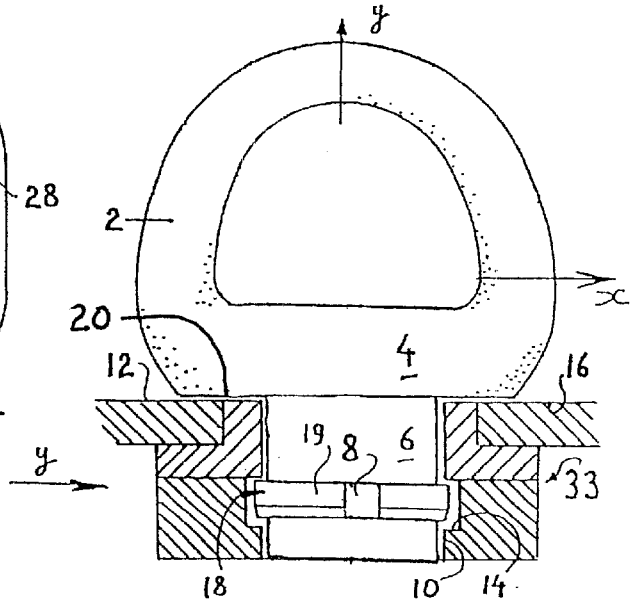
Figures 4A, 4B, 4C, 4D, 6, 7, 8:
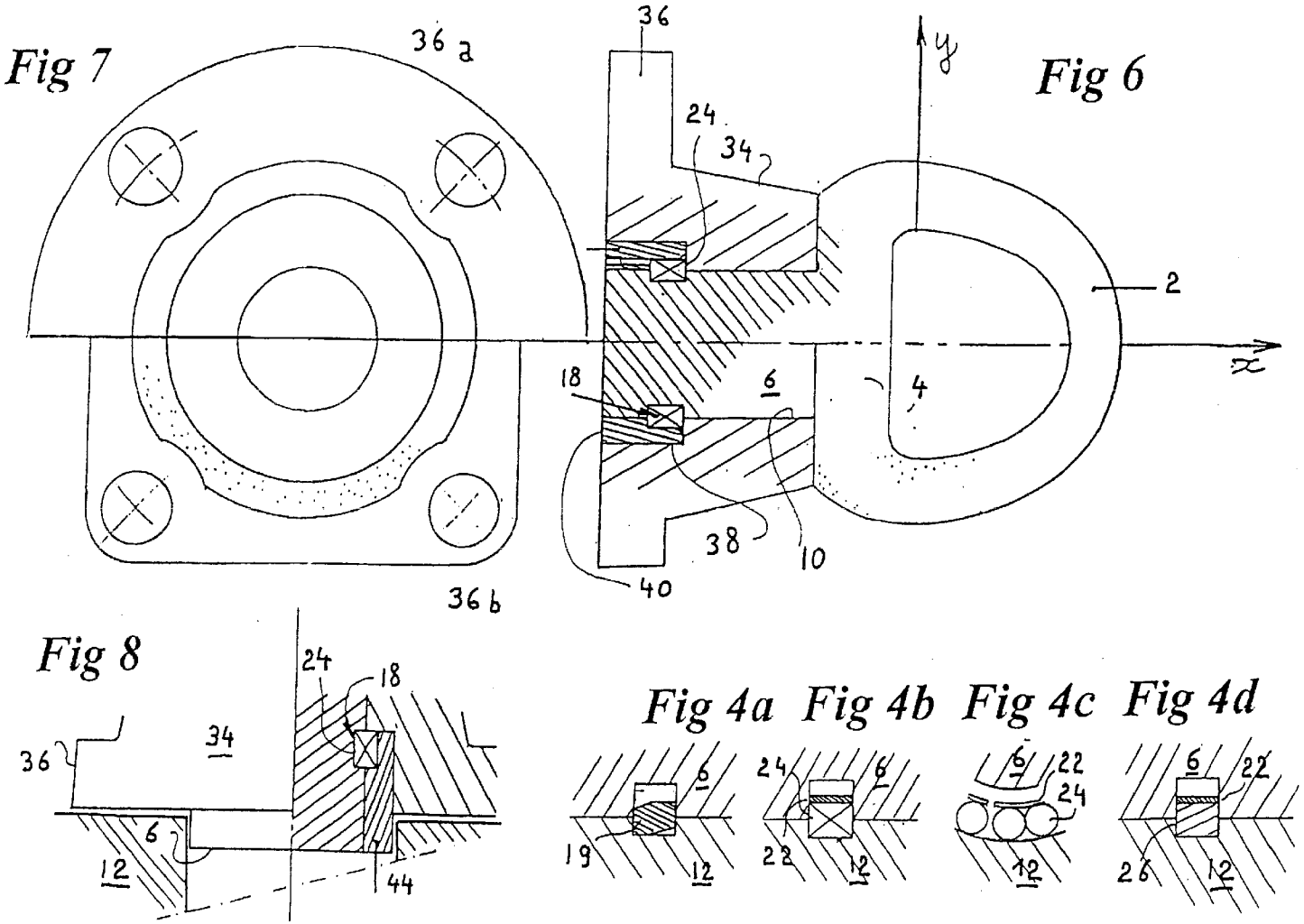

FIGS. 2 and 3 are side views of an embodiment in which the loop is a different shape FIGS. 4*a* to 4*d* are sectional views of details of the embodiment of the locking system of the pin FIG. 5 is a side view of a ring with base FIGS. 6 and 7 are combined views in lateral cross section and from beneath, respectively, of a ring with base with an axial clearance FIG. 8 is a sectional side view of a ring as in FIG. 6, with a lengthened pin.

Figure 9:
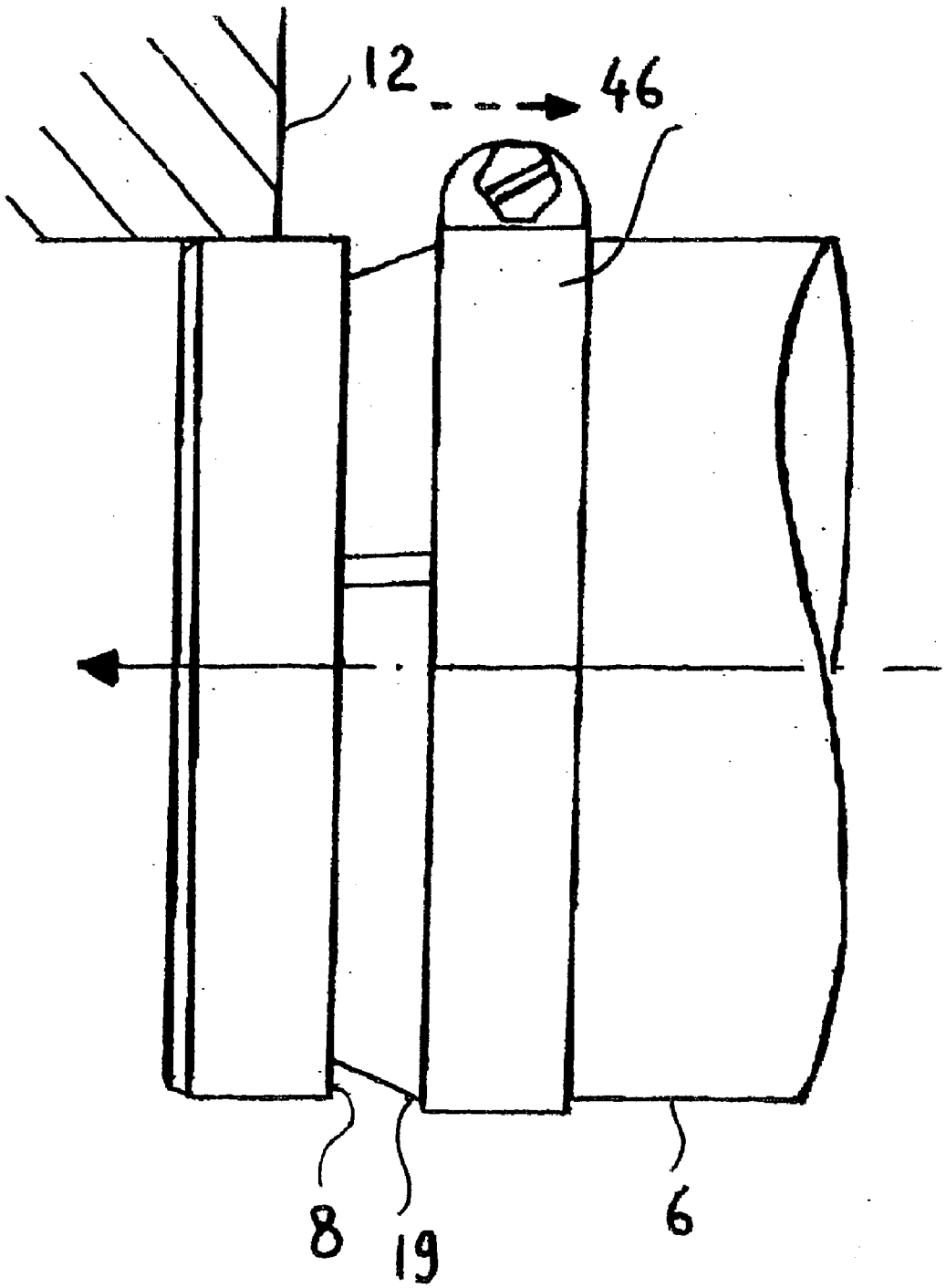

FIG. 9 is a sketch of the cylindrical pin being inserted into the body.

The figures are not drawn to scale. Generally, identical components are denoted by the same reference numerals in the figures.

DETAILED DESCRIPTION OF PREFERRED EMBODIMENTS

FIG. 1 is a general view of the lifting ring of the invention composed of a carrying loop 2 which here forms one piece with the pivoting body 4. This body 4 is extended rearwards by a. smooth pin 6.

The axes x and y define the directions of the lateral and axial stresses.

A peripheral groove 8 is formed in this pin 6, generally near the free end.

The pin 6 is inserted into a cylindrical housing 10 in the body of the load 12. A channel 14 encircles the cylindrical housing 10 at a depth from the plane of the surface 16 of the load 12 corresponding to the position of the groove 8 on the pin 6.

An expandable retainer ring 18 is placed in the groove of the pin 6. Here, the retainer ring 18 is a split spring-steel ring 19 treated to make it hard and with a profile designed to assist insertion and avoid the risk of closing up on itself during use.

Prior to insertion, the retainer ring 18 is kept compressed by a clamping collar 46 (See FIG. 9). When the pin 6 is pushed into the cylindrical housing 10, the retainer ring 18, which is slightly conical, begins to enter this housing 10 because of its elasticity. The clamping collar 46 slides back and, once the retainer ring 18 is inside the housing 10, can be withdrawn. The ring 1 is then simply pushed fully into its housing 10 until the retainer ring 18, arriving level with the channel 14, relaxes into it and so locks the ring 1.

The respective positions of the channel and groove are calculated to give the bearing face 20 of the ring 1 sufficient play to permit free rotation of the ring 1 relative to the body of the load 12.

The diameter of the smooth pin is of course calculated in such a way that even its thin part still has sufficient strength under axial tension.

FIGS. 4*a* to 4*d* show in further detail a number of different possible embodiments of the expandable retainer ring. FIG. 4*a* shows the split spring ring 19.

When the diameter of the pin is small, the split ring 19 may not have sufficient elasticity. In this case a leaf spring 22, wound into a spiral of more than one revolution, is used, as shown in FIGS. 4*b*, 4*c* and 4*d*. This leaf 22 is positioned underneath rollers 24 (FIGS. 4*b*, 4*c*) or segments 26, which it pushes outwards. To prevent any return towards the centre, the development of the leaf 22 is calculated so that its extremities come end to end after expansion. The rollers 24 or segments 26, engaged and held in the bottom of the channel 14, are made of very hard steel and work in shear in the case of axial tension.

FIGS. 2 and 3 show that the ring may, without departing from the scope of the invention, have loops 2 of various forms.

In FIG. 2, the loop 2 is in the form of a closed hoop 28 passing through an eye 30 incorporated in the body 4 of the ring. Traction can occur in any direction between x and y.

In FIG. 3, an intermediate link 32 is fitted between the eye 30 and the closed hoop 28. The hoop 28 can be oriented and hooked in the appropriate direction so that a hook swings in a plane parallel to the bearing face 16.

If the body of the load is thin-walled, it may be difficult or even impossible to insert the pin directly into it. In this case the cylindrical housing 10 is formed in a base 33, which in turn is fixed either directly to the wall of the load, or to the back of the wall, as shown in FIG. 5.

FIGS. 6, 7 and 8 show an embodiment in which the loop, mounted on a base 34, has a large clearance away from the bearing face of the load.

This embodiment is made possible by the great strength conferred by the smooth pin and by the gain in axial extension, due to the absence of any loop pivoting mechanism, since the body of the ring 1 is itself able to pivot.

Despite the large bending moment created by the clearance of the ring, the unit still has high strength.

The top views (FIG. 7) illustrate the possibility of making bases 34 with a large spread, bolted to the bearing face of the load. As shown, the bearing plate 36 of the base 34 may, depending on the total dimensions desired, be round or square in shape.

The pin 6 is retained either by a split retaining ring 18 or by rollers 24, or by very hard steel segments 26 working in shear.

The cylindrical housing 10 may, as shown in FIG. 6, pass through the entire length of the base 34 and include a larger-diameter section 38, which enables an annular holder 40 to be inserted through the back of the base 34 to keep the retainer ring 18 or its components (rollers 24, segments 26) in place.

In FIG. 8, the ring with the base is bolted down over a cavity formed in the body of the load. The diameter of this cavity is calculated so that a centering ring 44 can be inserted to give additional safety in the case of traction in the direction y.

It will be observed that the cavity may be a tapped hole in the base 34, thus allowing a conventional lifting ring to be secured in the same position if desired.

The ring and its tail are made in one piece forming a compact monolithic unit.

The clearance base is fixed to the load in such a way that it cannot pivot and in such a way as to form a whole integral with the load, creating a new bearing force taking the place of the initial offset force.

I claim:

1. A lifting ring for a load, comprising a carrying loop, a pivoting body and an anchor element that anchors in a load body, wherein the anchor element is a smooth cylindrical pin made in one piece with the pivoting body and the carrying loop, forming a compact monolithic unit, a peripheral groove being formed near the free end of the cylindrical pin, and a radially expandable retainer ring being inserted in said peripheral groove, said cylindrical pin being engaged and locked axially in a cylindrical housing integral with the body of the load, the cylindrical housing comprising a peripheral channel opposite the peripheral groove of the cylindrical pin, in which the expandable retainer ring is inserted.

2. A lifting ring according to claim 1, wherein the expandable retainer ring is a split spring ring.

3. A lifting ring according to claim 1, wherein the carrying loop has the form of an eye incorporated in the body, a loose closed loop passing through this eye.

4. A lifting ring according to claim 1, wherein the cylindrical housing is formed in a base fixed to the load body in such a way that it cannot pivot and forms an extension of the load body, the top of the base having a clearance forwards of the surface of the load body.

5. A lifting ring according to claim 4, wherein the cylindrical housing passes through the base.

6. A lifting ring according to claim 5, wherein there is a bearing plate on the base and the cylindrical housing comprises a section of larger diameter towards the bearing plate of the base, with an annular holder being inserted into said section between the base and the cylindrical pin to keep the expandable retainer ring in place.

7. A lifting ring according to claim 6 wherein the pin projects beyond the back of the base into a cavity of corresponding diameter formed in the body of the load.

8. A lifting ring according to claim 1, wherein a clamping collar keeps the expandable retainer ring compressed and in position before the cylindrical pin is inserted in an appropriate cylindrical housing.

9. A lifting ring for a load, comprising a carrying loop, a pivoting body and an element that anchors in a load body, wherein the anchor element is a smooth and cylindrical pin made in one piece with the body and the loop, forming a compact monolithic unit, a peripheral groove being formed near the free end of this pin, a radially expandable retainer ring comprising a spring part and roller or segment, the spring part exerting an outward force on said rollers or segments, being inserted in said groove, said pin being engaged and locked axially in a cylindrical housing integral with the body of the load, this cylindrical housing comprising a peripheral channel opposite the groove of the pin, in which the rollers or segments of the expandable retainer ring are inserted.

10. A lifting ring according to claim 9, wherein the cylindrical housing is formed in a base fixed to the load body in such a way that it cannot pivot and forms an extension of the load body, the top of the base having a clearance forwards of the surface of the load body.

11. A lifting ring according to claim 10, wherein the cylindrical housing passes through the base.

12. A lifting ring according to claim 11, wherein there is a bearing plate on the base and the cylindrical housing comprises a section of larger diameter towards the bearing plate of the base, with an annular holder being inserted into said section between the base and the cylindrical pin to keep the expandable retainer ring in place.

13. A lifting ring according to claim 12 wherein the pin projects beyond the back of the base into a cavity of corresponding diameter formed in the body of the load.

14. A lifting ring according to claim 9, wherein a clamping collar keeps the expandable retainer ring compressed and in position before the cylindrical pin is inserted in an appropriate cylindrical housing.

15. A lifting ring for a load, comprising a carrying loop, a pivoting body and an element that anchors in a load body, wherein the carrying loop has the form of an eye incorporated in the body, a loose closed loop passing through the eye the anchor element is a smooth cylindrical pin made in one piece with the body and the loop, forming a compact monolithic unit, a peripheral groove being formed near the free end of this pin, and a radially expandable retainer ring comprising a spring part and rollers or segments, the spring part exerting an outward force on said rollers or segments, being inserted in said groove, said pin being engaged and locked axially in a cylindrical housing integral with the body of the load, this cylindrical housing comprising a peripheral channel opposite the groove of the pin, in which the roller or segments of the expandable retainer ring are inserted.

16. A lifting ring according to claim 15, wherein the cylindrical housing is formed in a base fixed to the load body in such a way that it cannot pivot and forms an extension of the load body, the top of the base having a clearance forwards of the surface of the load body.

17. A pivoting body for use with a lifting ring for a load, the load including a load body, said pivoting body comprising a carrying loop and an anchor element for anchoring the pivoting body in said load body, a generally smooth cylindrical pin integral with the pivoting body, a peripheral groove formed near the free end of the cylindrical pin, and a radially expandable retainer ring carried in the groove, whereby the cylindrical pin can be engaged and locked in the load body, and a clamping collar for keeping the radially expandable retainer ring compressed and in position before the cylindrical pin is inserted into said load body.

18. A pivoting body as in claim 17, wherein the radially expandable retainer ring comprises an annular outer surface and a conical outer face extending therefrom towards the end of the cylindrical pin.

19. A pivoting body for use with a lifting ring for a load, the load including a load body, said pivoting body comprising a carrying loop and an anchor element for anchoring the pivoting body in said load body, a generally smooth cylindrical pin integral with the pivoting body, a peripheral groove formed near the free end of the cylindrical pin, and a radially expandable retainer ring carried in the groove, the radially expandable retainer ring comprising a spring part exerting an outward force on rollers or segments carried in said groove whereby the cylindrical pin can be engaged and locked in the load body.

* * * * *

UNITED STATES PATENT AND TRADEMARK OFFICE

CERTIFICATE OF CORRECTION

PATENT NO. : 6,478,350 B2
DATED : November 12, 2002
INVENTOR(S) : George Zullani It is certified that error appears in the above-identified patent and that said Letters Patent is hereby corrected as shown below:

Column 3,
Line 6, delete "." after -- a --.

Column 4,
Line 57, delete "a" and insert -- an expanding --.

Signed and Sealed this

Twenty-ninth Day of July, 2003

JAMES E. ROGAN
*Director of the United States Patent and Trademark Office*